US007990409B2

(12) United States Patent
Hasebe

(10) Patent No.: US 7,990,409 B2
(45) Date of Patent: Aug. 2, 2011

(54) IMAGE FORMING APPARATUS

(75) Inventor: Takashi Hasebe, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 849 days.

(21) Appl. No.: 11/875,055

(22) Filed: Oct. 19, 2007

(65) Prior Publication Data

US 2008/0158330 A1 Jul. 3, 2008

(30) Foreign Application Priority Data

Dec. 28, 2006 (JP) ..... 2006-355614

(51) Int. Cl.
*B41J 2/435* (2006.01)

(52) U.S. Cl. ..... 347/246; 347/236

(58) Field of Classification Search ..... 347/246, 347/236

See application file for complete search history.

(56) References Cited

U.S. PATENT DOCUMENTS

| | | | | |
|---|---|---|---|---|
| 2004/0194133 | A1 * | 9/2004 | Ikeda et al. | 725/37 |
| 2005/0120260 | A1 * | 6/2005 | Suzuki et al. | 714/5 |
| 2007/0290805 | A1 * | 12/2007 | Hatakeyama et al. | 340/10.1 |

FOREIGN PATENT DOCUMENTS

| | | | |
|---|---|---|---|
| JP | 11-174760 | | 7/1999 |
| JP | 11174760 | A * | 7/1999 |
| JP | 2001-239697 | | 9/2001 |
| JP | 2004-325891 | | 11/2004 |
| JP | 2005-96364 | | 4/2005 |

OTHER PUBLICATIONS

Notification of Reason for Refusal for Japanese Patent Application No. 2006-355614 mailed Aug. 5, 2008 with English Translation.

* cited by examiner

*Primary Examiner* — Stephen D Meier
*Assistant Examiner* — Sarah Al-Hashimi
(74) *Attorney, Agent, or Firm* — Cantor Colburn LLP

(57) ABSTRACT

Disclosed an image forming apparatus equipped with an exposure section including a plurality of LED elements, the apparatus forming an electrostatic latent image on a photosensitive body with the exposure section, the apparatus including: an RFID tag provided in the exposure section, the RFID tag including a light quantity correction data storing section and a communication section to perform wireless communication; an RFID reader/writer to perform the wireless communication with the RFID tag; a control section to allow the RFID reader/writer to perform the wireless communication with the RFID tag so as to read or write the light quantity correction data from/to the light quantity correction data storing section of the RFID tag during a period when no processing related to the image data is being performed; and a storage section to store the read light quantity correction data.

13 Claims, 6 Drawing Sheets

IMAGE FORMING APPARATUS

BACKGROUND

1. Field of the Invention

The present invention relates to an image forming apparatus equipped with a light emitting diode (LED) printer head as the exposure section thereof.

2. Description of Related Art

In recent years, an image forming apparatus using an LED printer head (hereinafter referred to as an LPH) as the exposure section thereof to form an electrostatic latent image on the surface of the photosensitive body thereof has been developed. In the LPH, LED chips, each of which includes a plurality of LED elements arranged in the main scanning direction according to a preset resolution, are arranged in an array, and the LPH includes an optical section, such as a graded index (GRIN) lens, which condenses irradiated lights emitted from the LED elements according to image data to form the electrostatic latent image on the photosensitive body.

It is known that the unevenness of light quantities is generated in such an LPH owing to the dispersion of the LED elements in manufacturing, the optical properties of the GRIN lens, and the like. The following technique in order to settle the unevenness of the light quantities is known. That is, the technique previously stores light quantity correction data into a nonvolatile storage section, from and to which data can electrically be erased and written, such as an electronically erasable and programmable read only memory (EEPROM). The light quantity correction data is for evening out the light quantities of a plurality of LED elements by digitally controlling the current values of driver circuits to light the LED elements. Moreover, the technique reads the light quantity correction data stored in the storage section into the control device thereof to wholly control the image forming apparatus to perform an exposure by the use of image data and the read light quantity correction data.

Moreover, the resolution in the main scanning direction (arranging direction of the LED chips) has been becoming higher to be 600 dpi, 1200 dpi, and so forth, with the realization of the densification of the arrangements of the LED elements. For example, if the maximum size of a recording medium on which an image forming apparatus can form an image is the A3 wide size (324 mm in width direction), then 7680 elements and 15360 elements of LED elements are arranged in the cases of 600 dpi and 1200 dpi of resolution, respectively.

In this manner, as the number of LED elements has increased with the heightening of the resolution, the data quantity to be controlled as image data has increased. Moreover, the exposure control method has also changed from only the one to perform simple on-off actions of the LED elements to the ones including the one to control a lighting exposure time on the basis of set numerical values of a plurality of bits, and consequently the traffic of the data to be used for an exposure has also increased. Consequently, it has become indispensable to mount an LPH interface equipped with a large-capacity and high-speed data communication function in order to meet the demand of the improvement of the productivity (high-speed capability) of the image forming apparatus.

Furthermore, to make it possible to form images on various recording media, an electrophotographic image forming apparatus is equipped with a plurality of image formation speeds in the same image forming apparatus according to the features (such as paper types and paper thicknesses) of various recording media in order to improve the fixation performance of toner, and the electrophotographic image forming apparatus must meet the data communication functions capable of coping with the image formation speeds according to the various recording media.

As an interface technique to realize the large-capacity and high-speed data communication function to the problems mentioned above, for example, there is a technique to attain the high-speed transfer of multi-bit data by the following measures. That is, on the transmission side, the technique performs the parallel-serial conversion of clock-synchronized parallel data by a low voltage differential signaling (LVDS) circuit, and performs the clock modulation according to the number of bits of the serial conversion by a phase locked loop (PLL) circuit. On the reception side, the technique restores the converted serial data to the input parallel data by performing the serial-parallel conversion of the serial data and restoring the modulation clock to the original clock by a receiver circuit equipped with a frequency modulation circuit. By that way, the technique attains the high-speed transfer of multi-bit data.

By adopting the technique mentioned above, it is possible to realize the large-capacity and high-speed data communication function by arranging a control signal, image data and light quantity correction data in parallel data, and the degree of freedom of the length of a bundled wire becomes high to make it possible to heighten the degree of freedom to the layout of the inside of the image forming apparatus. Accordingly, it becomes possible to intensively arrange the high-speed data processing section to unitize it.

However, although the technique mentioned above enables the high-speed communication of exposure data and the like to the LPH, the method increases the costs of circuit components and increases the production cost with the increase of the circuit components when the method is adopted as the means for reading the light quantity correction data of the LPH, and consequently the method causes a user an disadvantage. Moreover, the method has a problem of the impossibility of making the most of the performance of the LVDS circuit for exposure data owing to the limitation of the length of the bundled wires caused by the restriction of the circuit configuration to read light quantity correction data.

There is a method of mounting a storage section (for example, ROM) storing light quantity correction data inside the image forming apparatus as the means for solving the problem. However, because an image forming apparatus that is required to have a high speed and high durability needs the exchange of an LPH at the time of maintenance and the adjustment of light quantity correction data according to the process conditions and the frequency of usage, it is necessary to update the data of the storage section or to exchange the storage section every operation of the maintenance and the adjustment. Consequently, if the light quantity correction data suited to the LPH is not stored in the storage section owing to a trifling operation error, the incongruence becomes a cause of producing an image defection. Furthermore, the management of light quantity correction data is necessary also in the manufacturing process of the image forming apparatus, and the collation of the LPH mounted in the image forming apparatus with the light quantity correction data stored in the storage section becomes necessary to produce a new technical problem.

Consequently, a technique to provide a nonvolatile storage section that stores light quantity correction data in the LPH, and to read the light quantity correction data from the storage section has become general.

For example, Japanese Patent Application Laid-Open Publication No. 2001-239697 discloses an apparatus to control the lighting of LED elements by reading light quantity correction data from an EEPROM (storage section storing correction data) by a strobe signal, by supplying the read light quantity correction data to an LED driver IC as printing data, and by supplying a selection signal of LEDs with a strobe signal as an drive instruction of an LED array according to the printing data.

The Japanese Patent Application Laid-Open Publication No. 2001-239697 discloses that the technique makes a drive section (printing control section) generate a clock signal to obtain the light quantity correction data, and that the technique inputs the light quantity correction data stored in the storage section into the drive section in synchronization with the generated clock to transfer the light quantity correction data by the supplied clock. The technique aims to reduces the design margin accompanying a timing changes in the transfer clock of the printing data and the transfer clock of the light quantity correction data, that is, the technique separately considers the reading control of the light quantity correction data, the setting control of the light quantity correction data, and the transmitting method of the printing data, and the technique provides an interface circuit to balance each of them so that they can be processed severally by suitable methods.

However, because it is necessary for the conventional technique mentioned above to balance the interface of the whole image forming apparatus in order to improve the throughput of large-capacity light quantity correction data and the data communication capacity thereof (high-speed capability and reliability of transmission signal), the printing ability thereof is sacrificed. Consequently, the communication capacity of exposure data is limited by the reading and setting functions of the light quantity correction data from the storage section. Moreover, in the case where the length of the bundled wire is desired to be elongated, the length is also restricted by the interface circuit.

SUMMARY

The present invention was made in view of the situation mentioned above, and the object of the invention is to attain the facilitation of the reading/writing operations of light quantity correction data while attaining the speeding-up and the stabilization of communication of the light quantity correction data to heighten the reliability of an image forming apparatus.

In order to realize at least one of the objects mentioned above, an image forming apparatus reflecting an aspect of the present invention equipped with an exposure section including a plurality of LED elements, the apparatus forming an electrostatic latent image on a photosensitive body with the exposure section on the basis of image data, the apparatus includes: an RFID tag provided in the exposure section, the RFID tag including a light quantity correction data storing section to store light quantity correction data for adjusting light quantities of the LED elements and a communication section to perform wireless communication; an RFID reader/writer to perform the wireless communication with the RFID tag; a control section to read or write the light quantity correction data from the light quantity correction data storing section of the RFID tag by making the RFID reader/writer perform the wireless communication with the RFID tag during a period when no processing related to the image data is being performed; and a storage section to store the light quantity correction data read from the light quantity correction data storing section of the RFID tag by the control section.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE PREFERRED EMBODIMENT

In the following, the preferred embodiment of the present invention will be described in detail with reference to the attached drawings.

The configuration thereof is first described.

Figure 1:
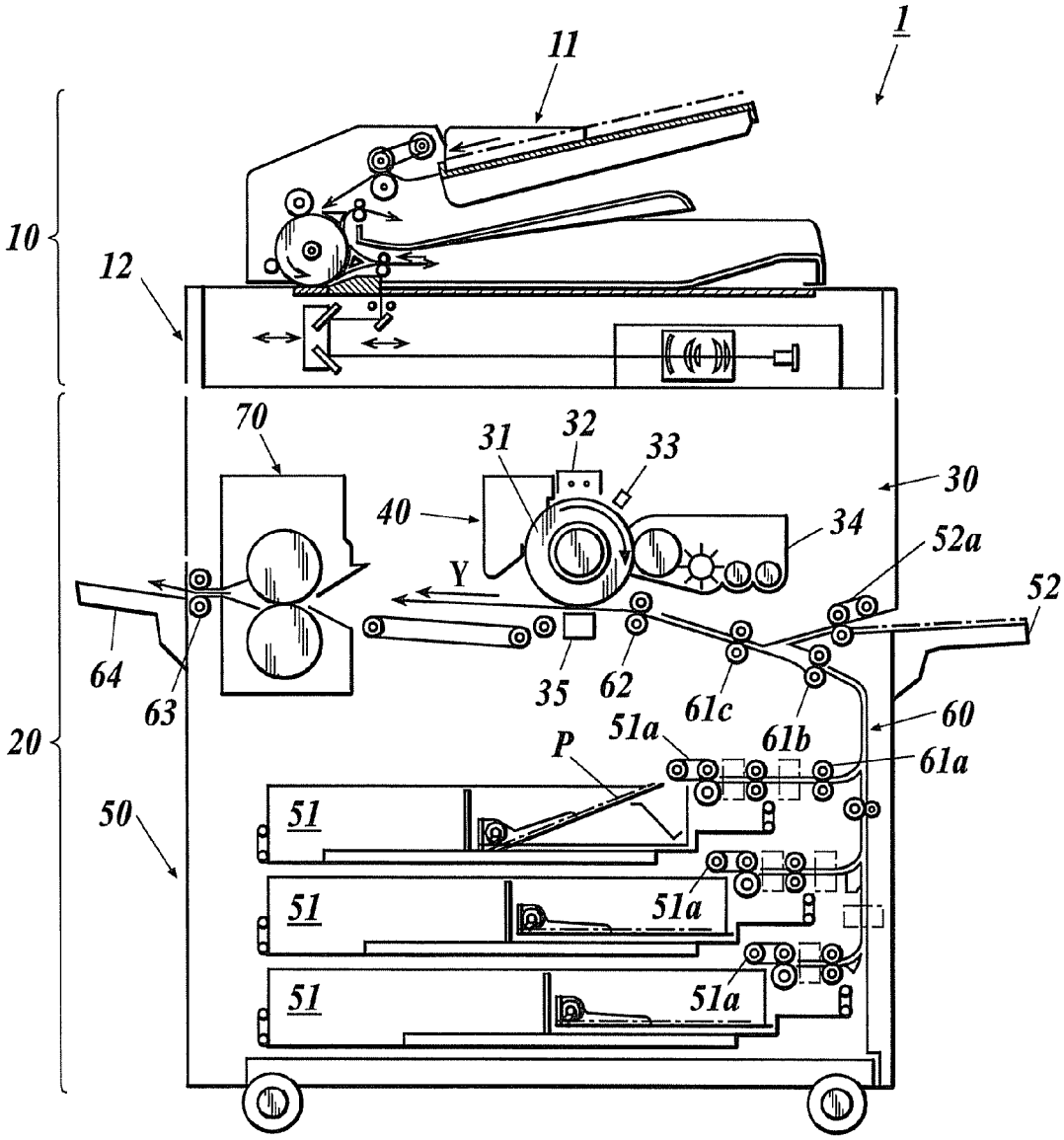
FIG. 1 is a view showing the configuration of a cross section of an image forming apparatus of the present embodiment.

FIG. 1 is a view showing the configuration of a cross section of an image forming apparatus 1 of the present embodiment.

The image forming apparatus 1 is a digital multifunction peripheral equipped with a copy function to read an image from an original document and form an image of the read image on a recording medium P such as paper, a printer function to receive image data from a higher-level device such as a personal computer (PC) and outputs the image expressed by the image data by forming the image on the recording medium P, and the similar function. As shown in FIG. 1, the image forming apparatus 1 is composed of an image reading section 10 and a print section 20.

The image reading section 10 includes an automatic document feeding section 11 called as an auto document feeder (ADF) and a reading section 12.

The automatic document feeding section 11 conveys the documents loaded on the document tray thereof one by one from the uppermost one in order, and passes the document on the contact glass thereof, which is located at the reading position of the document, with the document stuck fast to the contact glass. The automatic document feeding section 11 then ejects the document that has passed the contact glass and the reading of which has been finished onto the ejection tray thereof.

The reading section 12 includes a scanner composed of a light source, a lens, the contact glass, and a charge coupled device (CCD). The reading section 12 reads the document image (analog image signal) of an original document by focusing the reflected lights of the lights radiated to the document to form an image and by performing the photoelectric conversion of the focused image, and performs various kinds of image processing, such as the analog/digital (A/D) conversion of the analog image signal, to the read document image. After that, the reading section 12 outputs the processed image data to the print section 20 as print data. The image is here intended not to limit to the image data such as the data of a figure, a picture, and the like, but to include text data such as the data of a character, a sign, and the like.

The print section 20 is a section to form the image of the electrophotographic system on the basis of the input print data. The print section 20 is composed of an image forming section 30, a cleaning section 40, a paper feeding section 50, a conveying section 60, and a fixing section 70.

The image forming section 30 includes a photosensitive drum 31, a charging device 32, an LED printer head (hereinafter referred to as LPH) 33 as an exposure section, a developing device 34, and a transferring device 35. In the image forming section 30, a light is radiated from the LPH 33, which is provided at a position opposed to the surface to be exposed of the photosensitive drum 31 charged by the charging device 32, to the surface to be exposed. An electrostatic latent image is then formed thereon, and the toner charged by the developing device 34 is adhered on the exposed surface of the photosensitive drum 31, on which the electrostatic latent image is formed. A toner image is thus formed, and the toner image is transferred onto the recording medium P by the transferring device 35.

The LPH 33 is configured in such a way that a plurality of light emitting diode (LED) elements is linearly arranged in the axial direction (main scanning direction X) of the photosensitive drum 31. The LPH 33 selectively lights the plurality of LED elements according to image data (data signal).

The cleaning section 40 removes residual charges, residual toner, and the like, on the surface of the photosensitive drum 31 after the toner image has been transferred onto the recording medium P.

The paper feeding section 50 includes a plurality of paper feeding trays 51 and a manual paper feeding tray 52.

Each of the paper feeding trays 51 houses the recording media P distinguished in advance by the sizes or the types of the recording media P, and conveys the housed recording media P with paper feeding rollers 51*a* toward the conveying section 60 one by one from the uppermost sheet of the stack of the recording media P. The manual paper feeding tray 52 is configured to enable a user to load various types of recording media P depending on the users needs on all such occasions, and conveys the loaded recording media P toward the conveying section 60 with paper feeding rollers 52*a* one by one from the uppermost sheet.

The conveying section 60 conveys the recording medium P conveyed from one of the paper feeding trays 51 or the manual paper feeding tray 52 to the transferring device 35 through a plurality of intermediate rollers 61*a*, 61*b*, and 61*c*, and resist rollers 62.

The fixing section 70 performs the heat fixing of the toner image transferred onto the recording medium P conveyed by the conveying section 60. The recording medium P subjected to the fixing processing is output onto a ejection tray 64 by being nipped by paper ejecting rollers 63.

Incidentally, although the case where the image forming apparatus 1 of the present embodiment is provided with one image forming section 30 is exemplified to be described, the image forming apparatus provided with a plurality of image forming sections 30 each for each color may be used for forming a color image.

Figure 2:
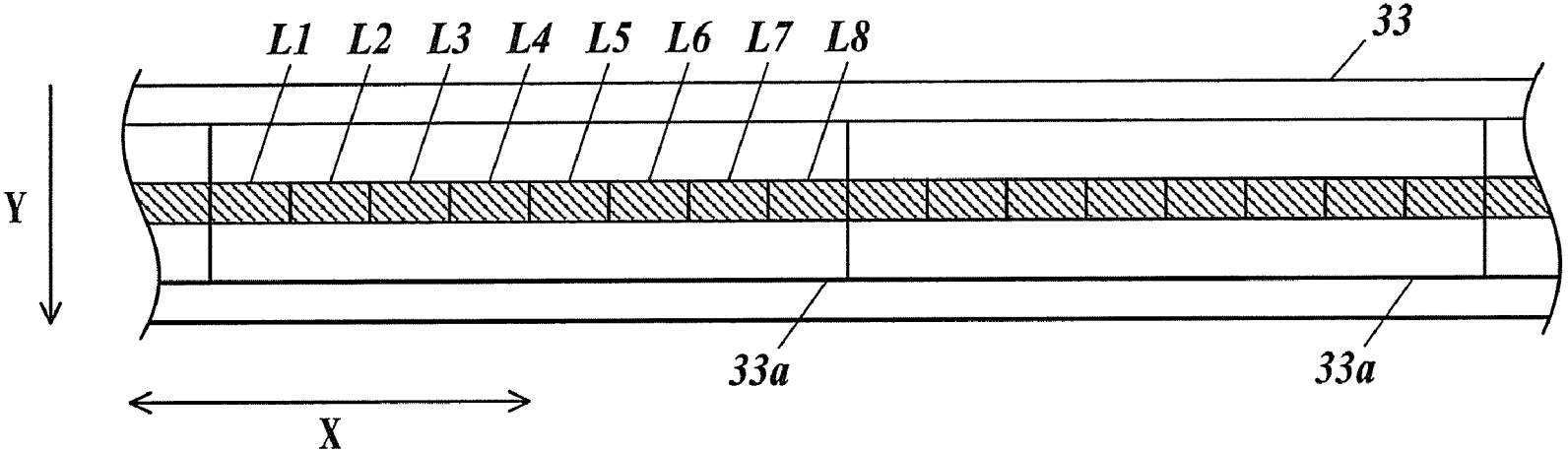
FIG. 2 is a partially enlarged plan view showing the schematic configuration of an LPH.

FIG. 2 is a partially enlarged plan view showing the schematic configuration of the LPH 33.

As shown in FIG. 2, the LPH 33 is composed of a plurality of LED head modules 33*a* arranged in the main scanning direction X. Each of the LED head modules 33*a* includes a plurality of LED elements. Each of the LED elements is linearly arranged at intervals corresponding to the preset resolution in the main scanning direction X, and is sequentially lighted in the main scanning direction X by a time-sharing method.

In each of the LED head modules 33*a* shown in FIG. 2, a first to an eighth LED elements L1-L8 are linearly arranged in the main scanning direction X at regular intervals with predetermined intervals according to the resolution of the main scanning direction X, and the LED elements L1-L8 are sequentially lighted from the first LED element L1 by being divided into eight parts. By the sequential lighting of the first to the eighth LED elements L1-L8 at equal intervals by the time-sharing method, a latent image for one scanning line is written on the photosensitive drum 31.

The LPH 33 shown in FIG. 2 is equipped with the plurality of LED head modules 33*a* corresponding to, for example, the resolution of 1200 dpi in the main scanning direction X.

Each of the LED elements of each of the LED head modules 33*a* shown in FIG. 2 corresponds to one pixel. The first to the eighth LED elements L1-L8 are linearly arranged in the direction extending in the main scanning direction X in such a way that the mutual shifts of the arranged positions of the LED elements in the sub scanning direction Y are within a range from 20 μm to 200 μm, both inclusive. The LED elements L1-L8 are sequentially lighted from the first LED element L1 to the eighth LED element L8 at equal intervals by being divided into eight pieces, that is, every eighth LED element (i.e. every eighth pixel) on one scanning line are sequentially lighted at intervals.

The lighting control of the LPH 33, which has the configuration shown in FIG. 2, and the lighting of which is controlled as above, is easy by adopting the time-sharing lighting of one scanning line, and because the lighting is eight-divided lighting, the lighting is even number time-sharing lighting. Consequently, it is possible to make each of the LED elements light equally per unit time, and lighting control can be performed by the eight bits, i.e. by the one byte. The LPH 33 thus has a feature of having good controllability.

Figure 3:
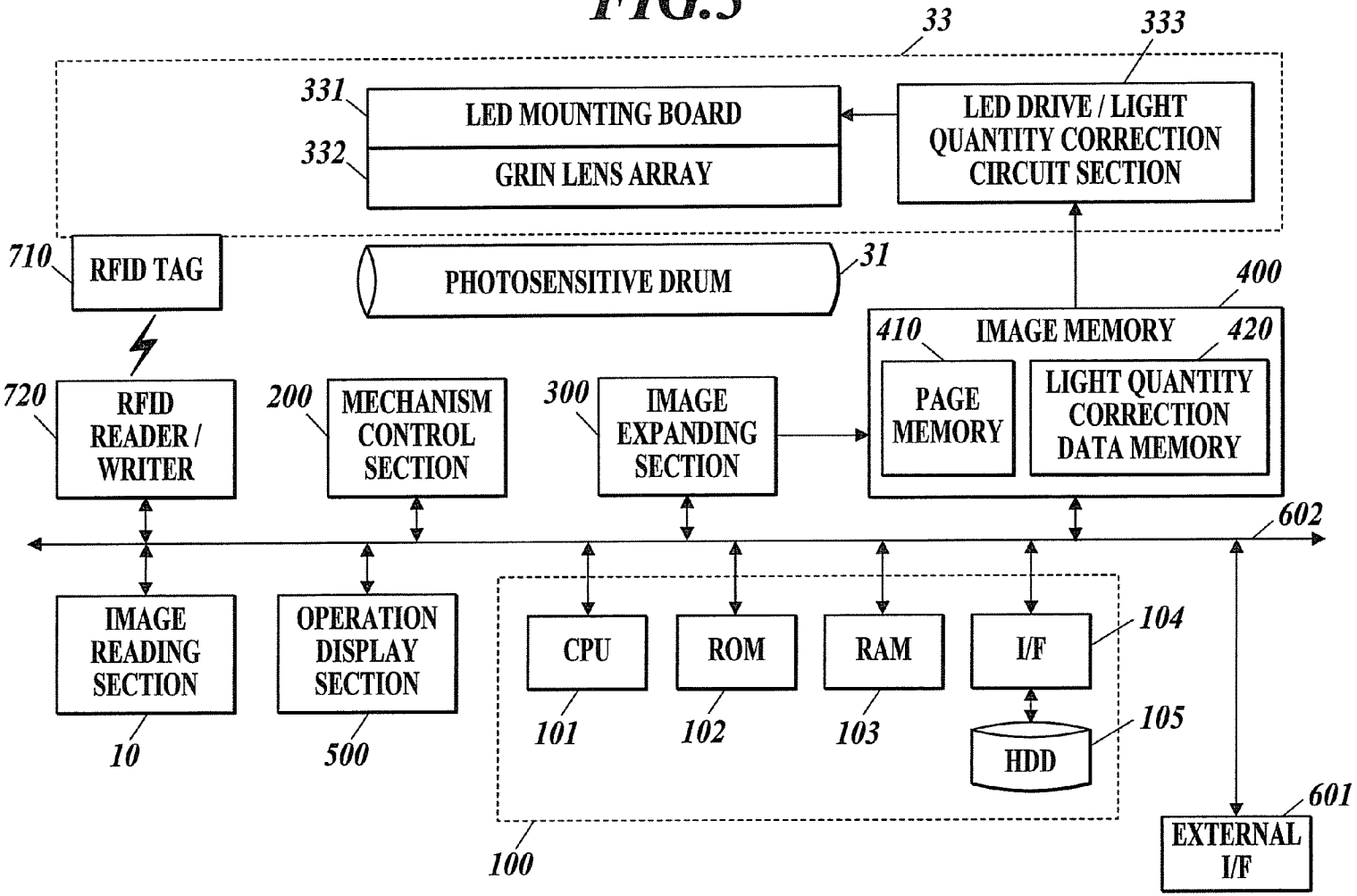
FIG. 3 is a control block diagram of the image forming apparatus.

FIG. 3 shows a control block diagram of the image forming apparatus 1.

As shown in FIG. 3, the image forming apparatus 1 is composed of a main body control section 100, a mechanism control section 200, an image expanding section 300, an image memory 400, an operation display section 500, an external interface (I/F) 601, a radio frequency identification (RFID) tag 710 provided in the LPH 33, an RFID reader/writer 720, the image reading section 10, a printing section (not shown), and the like. Each component section is connected to one another through a bus 602 as a communication section.

The main body control section 100 includes a central processing unit (CPU) 101, a read only memory (ROM) 102, a random access memory (RAM) 103, a hard disk drive (HDD) 105 connected to the bus 602 through an I/F 104, and the like.

The CPU 101 reads a system program, each processing program, and data that are stored in the ROM 102, expands the read programs in the RAM 103 or the HDD 105, and performs the integrated control of the operation of each section of the image forming apparatus 1 in accordance with the expanded programs. The CPU 101 performs the timing control of the whole system, the storage and accumulation control of image data by the use of the RAM 103 or the HDD 105, the image processing (variable power processing, filtering, γ conversion, and the like) of image data transmitted from the image reading section 10 or the like, the input-output control of image data to the print section 20, and the interfacing (I/F) and operation control with the other applications (such as facsimile (FAX), printer, and scanner).

Moreover, the CPU 101 temporarily stores the image data that has been transmitted from an external apparatus such as a personal computer (PC) and has been received through the external I/F 601, and the image data transmitted from the image reading section 10 into the RAM 103 or the HDD 105, and expands the print data based on the image data into the image expanding section 300. The CPU 101 outputs an activation instructing signal to the mechanism control section 200, and makes each section of the image forming apparatus 1 perform the operation thereof.

The ROM 102 previously stores the programs and the data that the image forming apparatus 1 can deal with, and stores the system program, various processing programs corresponding to the system, and the data necessary for performing the processing of the various processing programs.

Moreover, the ROM 102 previously stores the program and the data necessary for the execution of the program that enables the execution of light quantity correction data reading processing or light quantity correction data writing processing for making the RFID reader/writer 720 perform wireless communication with the RFID tag 710 to read or write the light quantity correction data stored in the RFID tag 710 in the period when the present embodiment does not perform any processing related to image data.

The period when no processing related to image data is being performed indicates, for example, a period when an image is being formed on a recording medium on the basis of the image data, and the periods during which the processing to obtain the image data by reading the image data from an original document with the image reading section 10, the processing to obtain the image data from an external apparatus, the processing of the storage and accumulation control of the obtained image data, the image processing (such as variable power processing, filtering, and γ conversion processing) of the obtained image data, the input-output control processing of the image data to the print section 20, and the adjustment processing of various sensors and mechanisms necessary for performing these various kinds of processing are not being performed.

In the present embodiment, as the periods during which the processing related to the image data is not being performed, it is supposed that at least one of the following periods is set: a period from the start of supplying electric power to the image forming apparatus 1 to the start of the processing related to the image data (hereinafter referred to as activation period), a period when the processing related to the image data is not being performed in the state in which the electric power is supplied to the image forming apparatus (hereinafter referred to as waiting period), and a period from the stop of the processing related to the image data after the acceptance of a stop instruction of the supply of the electric power to the image forming apparatus 1 from the operation display section 500 to the stop of the supply of the electric power (hereinafter referred to as ending period).

By the setting of at least one of the activation period, the waiting period, and the ending period, the reading or the writing of the light quantity correction data can be performed by the wireless communication between the RFID tag 710 and the RFID reader/writer 720 without generating the influences of electromagnetic waves caused by the wireless communication.

In the light quantity correction data reading processing, the checksum data of the light quantity correction data read from the RFID tag 710 is calculated, and the calculated checksum data is collated with the checksum data included in the read light quantity correction data (hereinafter referred to as first collation processing). Furthermore, if the activation period or the waiting period is set as the period when the processing related to the image data is not being performed, then the checksum data calculated on the basis of the read light quantity correction data is collated with the checksum data included in the light quantity correction data stored in a light quantity correction data memory 420, which will be described later, in the image memory 400 (hereinafter referred to as second collation processing).

The RAM 103 and the HDD 105 function as temporary storing regions of the programs read from the ROM 102, input or output data, parameters, and the like, in various kinds of processing executed by the CPU 101.

The mechanism control section 200 is a section to wholly control various drive mechanisms, various sensors, and the like, in the image forming apparatus 1 on the basis of the signals from the main body control section 100, and the mechanism control section 200 controls, for example, the drive of the motor to rotate photosensitive drum 31 at a fixed speed.

The image expanding section 300 generates the data to be a print object to be output on the basis of the print data received from the main body control section 100, and the like, and makes the data be stored in a page memory 410 in the image memory 400.

The image memory 400 includes the page memory 410 composed of a dynamic random access memory (DRAM) or the like, and the light quantity correction data memory 420 composed of a rewritable nonvolatile memory, such as an electronically erasable and programmable read only memory (EEPROM).

The page memory 410 is a memory for storing the print data generated by the image expanding section 300, and outputs various signals based on the generated print data to the LPH 33.

The light quantity correction data memory 420 is a storage section to store the light quantity correction data read from the RFID tag 710 by the main body control section 100, and outputs the light quantity correction data to the LPH 33 in synchronization with the various signals output from the page memory 410.

The operation display section 500 is composed of a display screen using a liquid crystal display (LCD) or an organic electronic luminescent (EL) element, an operation key group including a power source switch, an operation display control section, and the like. A touch panel is provided over the display screen in the way of covering the display screen. The operation display control section displays various setting screens for inputting various setting conditions, the operation states of the image forming apparatus 1, processing results, and the like, on the display screen in accordance with the display signals input from the main body control section 100. Moreover, the operation display control section transmits the operation signals input from the operation key group or the touch panel to the main body control section 100.

Moreover, the operation display section 500 realizes the function as an informing section to display an informing screen to inform the abnormality of the display signal input from the main body control section 100 on the display screen when the result of the collation of the checksum data calculated from the light quantity correction data read from the RFID tag 710 with the checksum data included in the light quantity correction data stored in the light quantity correction data memory 420, or the result of the collation of the checksum data calculated from the light quantity correction data read from the RFID tag 710 with the checksum data included in the read light quantity correction data shows disagreement.

The external I/F 601 is composed of various interfaces such as a network interface card (NIC), a modulator-demodulator (MODEM), and a universal serial bus (USB), and mutually performs the transmission and the reception of information with an external device connected in a state capable of performing communication.

The RFID tag 710 is provided to the LPH 33 by being stuck to it or by the similar method. The RFID tag 710 is a batteryless type RFID tag, which includes an integrated circuit (IC) chip as a light quantity correction data storing section to store light quantity correction data to adjust the light quantity of each of the LED elements equipped in the LPH 33 and a coil as the communication section to perform wireless communication, and which performs the transmission and the reception of the light quantity correction data stored in the IC chip with the RFID reader/writer 720 in response to the electric power that has been generated by the inductive electromagnetic field supplied by RFID reader/writer 720 and is supplied to the RFID tag 710.

The RFID reader/writer 720 is connected to the main body control section 100 through the bus 602. The RFID reader/writer 72 includes a coil to perform wireless communication with the RFID tag 710 in accordance with an instruction from the main body control section 100 to supply an inductive electromagnetic field to the RFID tag 710 by the coil, and performs the transmission and the reception of the light quantity correction data stored in the RFID tag 710.

Incidentally, although the description is performed by exemplifying the electromagnetic induction type ones as the RFID tag 710 and the RFID reader/writer 720 of the present embodiment, they may be electric wave type ones.

It is regarded that the wireless frequency that the RFID tag 710 and the RFID reader/writer 720 of the electromagnetic induction type or the electric wave type can use is under legal restrictions in some places (districts, countries, and the like) where the image forming apparatus 1 is used.

In the case of the RFID tag 710 and the RFID reader/writer 720 of the electromagnetic induction type, they can be used in Japan, the United States of America, and Europe in the radio frequency bands of, for example, the frequency band of 135 KHz or less or the frequency band of 13.56 MHz.

On the other hand, in the case of the RFID tag 710 and the RFID reader/writer 720 of the electric wave type, for example, the wireless frequency band of 433 MHz cannot be used in Japan, but can be used in the United States of America and Europe. The wireless frequency band from 860 MHz to 960 MHz cannot be used in Japan, but can be used in the United States of America. The wireless frequency band of 2.45 GHz can be used all in Japan, the United States of America, and Europe. The legal restrictions of usable wireless frequency bands are thus strictly regulated.

Accordingly, it is preferable in terms of design costs and the like to use the RFID tag 710 and the RFID reader/writer 720 of the electromagnetic induction type, the legal regulations of which are on a trend to be almost unified in each country.

The LPH 33 includes: an LED mounting board 331, on which a plurality of LED head modules 33*a* is mounted; an optical section composed of a GRIN lens array 332, on which a plurality of GRIN lenses is arranged in order to focus the lights radiated from the LED elements onto the photosensitive drum 31 to form an image, and the like; and an LED drive/light quantity correction circuit section 333.

The LED drive/light quantity correction circuit section 333 is a circuit to perform the correction operation of the light quantity of each LED and the drive operation thereof on the basis of various signals output from the page memory 410 in the image memory 400 and light quantity correction data output from the light quantity correction data memory 420 in synchronization with the various signals.

It is known that the light quantity of each LED differs from one another owing to the dispersion of the mechanical characteristics thereof and the electrical characteristics thereof at the time of manufacturing the LEDs, the dispersion of the resistance to the passage of electrical currents of the LED drive circuit, the electrical dispersion of mounted members (such as the LED mounting board 331), and the like, even if the LEDs are driven under the same conditions. In order to keep the dispersion of the light quantity of the whole of the LPH 33 within a fixed range, a correction section to correct the current quantity, the rise drive characteristic, and the light quantity of each LED element is provided in the LED drive/light quantity correction circuit section 333.

Next, the operation of the present embodiment is described.

Figure 4:
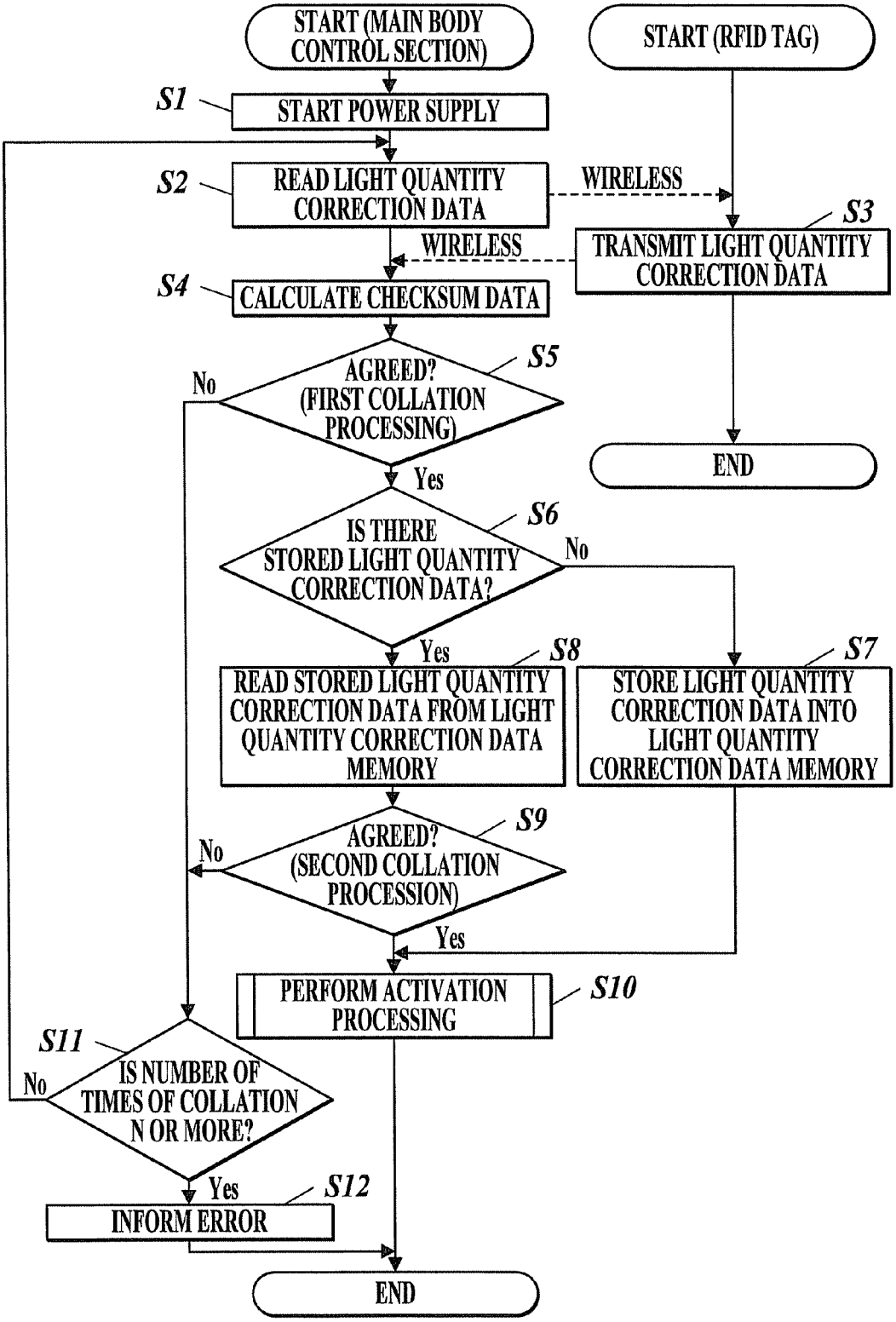
FIG. 4 is a flow chart of light quantity correction data reading processing in the case where an activation period is set as a period when processing related to image data is not being performed.
Figure 5:
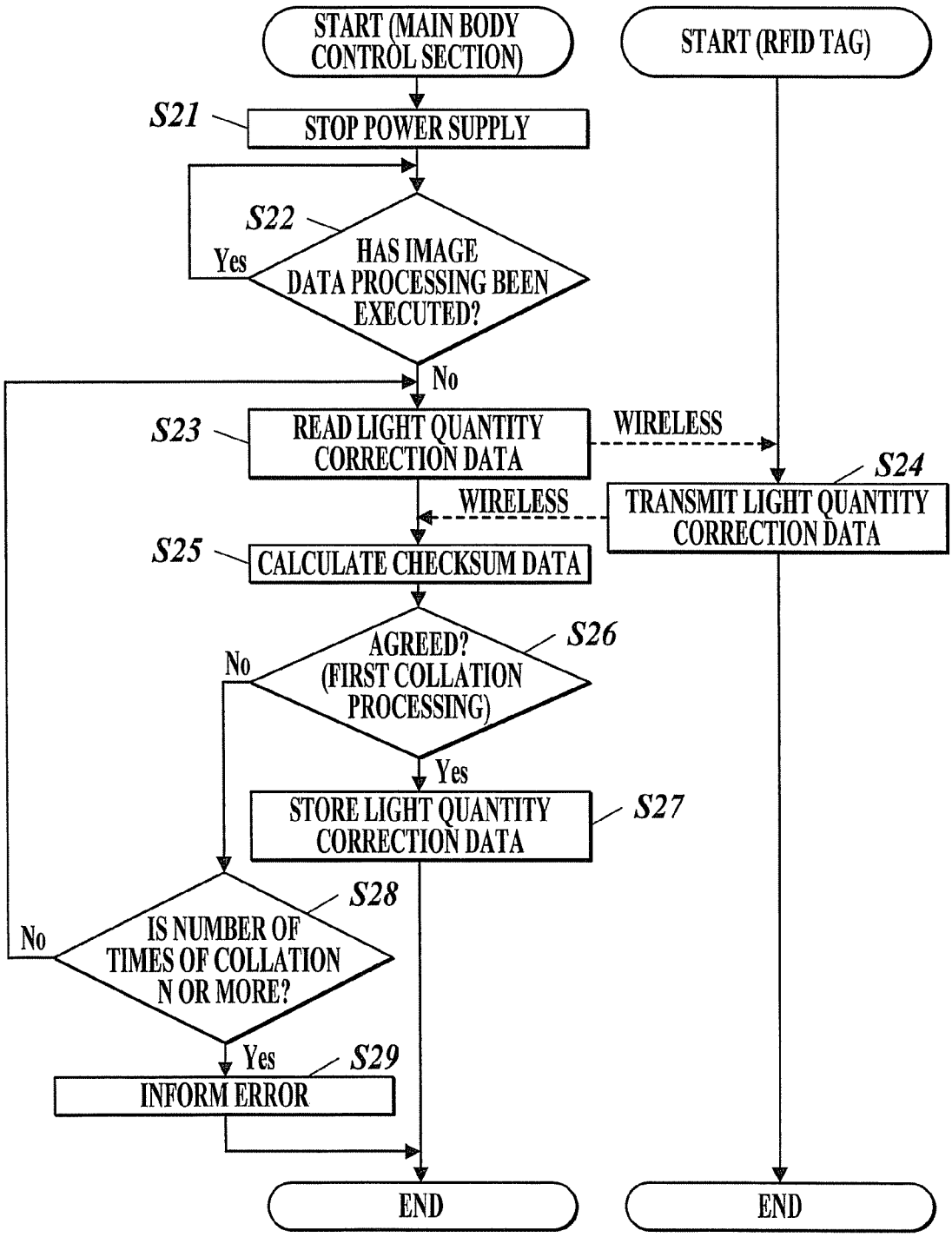
FIG. 5 is a flow chart of the light quantity correction data reading processing in the case where an ending period is set as the period when the processing related to the image data is not being performed.
Figure 6:
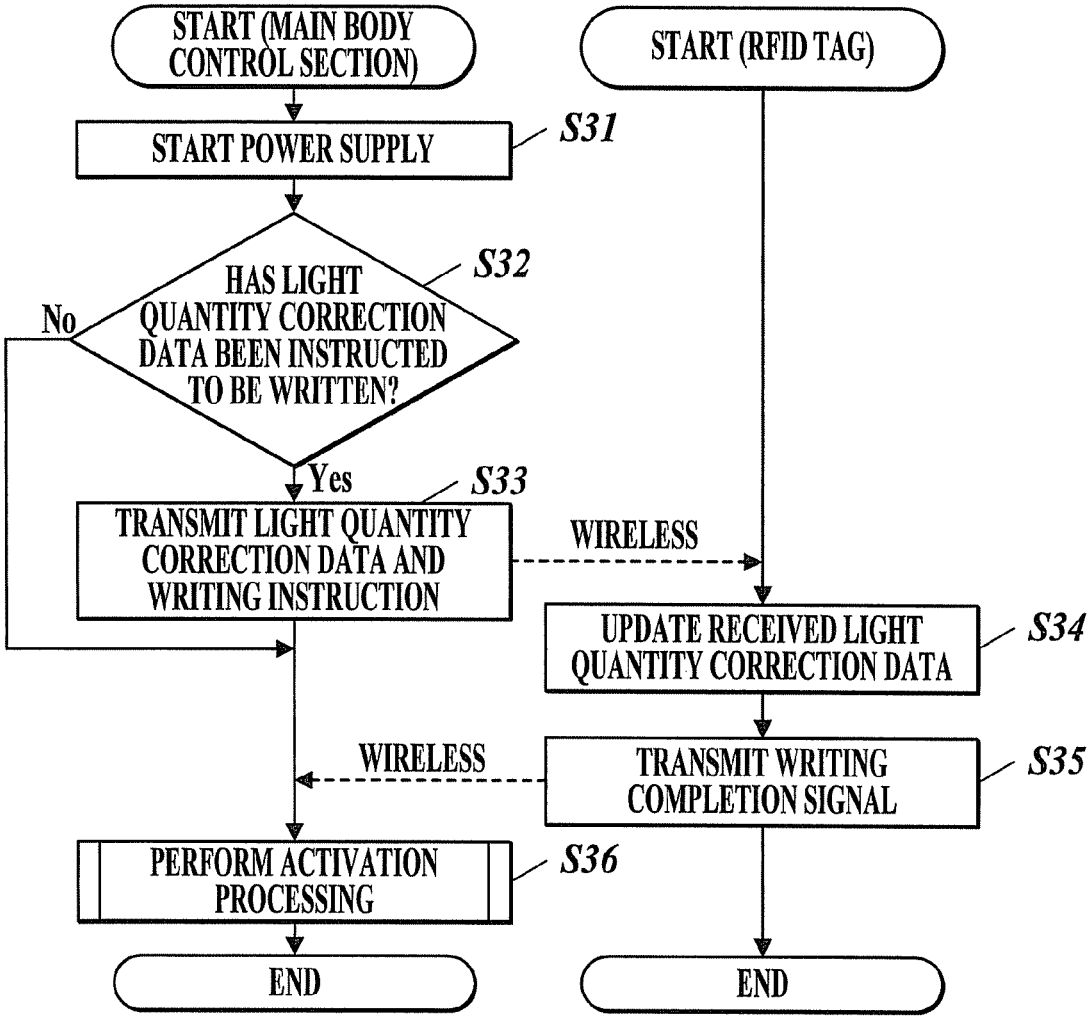
FIG. 6 is a flow chart of the light quantity correction data writing processing in the case where the activation period is set as the period when the processing related to the image data is not being performed.

The processing shown in FIGS. 4-6 relates to the operations realized by the cooperation of the CPU 101, the ROM 102, and the RAM 103 or the HDD 105 in the main body control section 100, and the main body control section 100 realizes the functions as the control section.

FIGS. 4 and 5 show flow charts of light quantity correction data reading processing of the present embodiment.

The flow chart of the light quantity correction data reading processing shown in FIG. 4 shows an example of the flow chart in the case where an activation period is set as the period when no processing related to image data is being performed, and the flow chart of the light quantity correction data reading processing shown in FIG. 5 shows an example of the flow chart in the case where an ending period is set as the period when no processing related to image data is being performed.

The flow chart of the light quantity correction data reading processing shown in FIG. 4 is first described.

When the supply of electric power to the image forming apparatus 1 is started by an operation of the power source switch provided in the operation display section 500 of the image forming apparatus 1 (Step S1), the RFID reader/writer 720 is driven to read light quantity correction data from the RFID tag 710 (Step S2).

The RFID tag 710 transmits the light quantity correction data stored in the IC chip to the RFID reader/writer 720 in response to the supply of the electric power generated by the inductive electromagnetic field supplied from the RFID reader/writer 720 (Step S3).

When the RFID reader/writer 720 has received the light quantity correction data from the RFID tag 710 and the light quantity correction data has been read from the RFID tag 710, the checksum data of the light quantity correction data read from the RFID tag 710 is calculated (Step S4). The collation of the calculated checksum data with the checksum data included in the light quantity correction data read from the RFID tag 710 is performed (first collation processing), and it is judged whether the calculated checksum data agrees with the checksum data included in the read light quantity correction data or not, that is, whether the result of the first collation processing indicates agreement or not (Step S5).

When it is judged that the result of the first collation processing indicates disagreement (Step S5; No), the processing advances to Step S11.

When it is judged that the result of the first collation processing indicates agreement (Step S5; Yes), it is judged whether any light quantity correction data is stored in the light quantity correction data memory 420 or not (Step S6). When it is judged that no light quantity correction data is stored (Step S6; No), the light quantity correction data read from the RFID tag 710 is stored in the light quantity correction data memory 420 (Step S7), and the processing advances to Step S10.

When it is judged that light quantity correction data is stored in the light quantity correction data memory 420 (Step S6; Yes), the light quantity correction data stored in the light quantity correction data memory 420 is read (Step S8).

In the case where the activation period and the ending period are set as the periods during which no processing related to image data is being performed, it is preferable that the light quantity correction data stored in the ending period is read as the light quantity correction data read from the light quantity correction data memory 420 at the Step S8.

The collation of the checksum data calculated at the Step S4 with the checksum data included in the light quantity correction data read at the Step S8 is performed (second collation processing), and it is judged whether the checksum data calculated at the Step S4 agrees with the checksum data included in the light quantity correction data read at the Step S8 or not, that is, whether the result of the second collation processing indicates agreement or not (Step S9).

When it is judged that the result of the second collation processing indicates agreement (Step S9; Yes), or after the processing at the Step S7, the activation processing of the processing related to image data in the image forming apparatus 1 is started (Step S10), and the present processing is ended.

When it is judged that the result of the first collation processing indicates disagreement (Step S5; No), or when it is judged that the result of the second collation processing indicates disagreement (Step S9; No), it is judged whether or not the number of times of collation of at least one piece of the first collation processing and the second collation processing is a preset number of times (n in the present embodiment) or more (Step S11).

When it is judged that the number of times of collation of at least one piece of the first collation processing and the second collation processing is not the preset number of times or more (Step S11; No), the processing returns to that at the Step S2.

When it is judged that the number of times of collation of at least one piece of the first collation processing and the second collation processing is the preset number of times or more (Step S11; Yes), an informing screen to inform abnormality is displayed on the display screen of the operation display section 500, and thereby error information is performed to a user (Step S12). The present processing is then ended.

Incidentally, the flow chart in the case where a waiting period is set as the period when no processing related to image data is being performed is the one in which the Step S1 shown in FIG. 4 is set as the case where it is judged that no processing related to image data is being performed, and in which the Step S10 is deleted. Because the other steps of the flow chart is almost the same as those of the flow chart shown in FIG. 4, the illustration and the description of the former flow chart is omitted.

Next, the flow chart of the light quantity correction data reading processing shown in FIG. 5 is described.

When an instruction to stop the supply of electric power to the image forming apparatus 1 is performed by an operation of the power source switch provided in the operation display section 500 of the image forming apparatus 1 (Step S21), it is judged whether any processing related to image data is performed or not (Step S22).

When it is judged that processing related to image data is being performed (Step S22; Yes), the processing returns to Step S22, and the processing stands by until the processing related to image data comes not to be performed.

When it is judged that no processing related to image data is performed (Step S22; No), the RFID reader/writer 720 is driven to read light quantity correction data from the RFID tag 710 (Step S23).

The RFID tag 710 transmits the light quantity correction data stored in the IC chip to the RFID reader/writer 720 in response to the supply of the electric power generated by the inductive electromagnetic field supplied from the RFID reader/writer 720 (Step S24).

When the RFID reader/writer 720 has received the light quantity correction data from the RFID tag 710 and the light quantity correction data is read from the RFID tag 710, the checksum data of the read light quantity correction data is calculated (Step S25). The collation of the calculated checksum data with the checksum data included in the read light quantity correction data is then performed (first collation processing), and it is judged whether the calculated checksum data agrees with the checksum data included in the read light quantity correction data or not, that is, whether the result of the first collation processing indicates agreement or not (Step S26).

When it is judged that the result of the first collation processing indicates agreement (Step S26; Yes), the light quantity correction data read from the RFID tag 710 is stored into the light quantity correction data memory 420 (Step S27), and the present processing is ended.

When it is judged that the result of the first collation processing indicates disagreement (Step S26; No), it is judged whether or not the number of times of collation of the first collation processing is a preset number of times (n in the present embodiment) or more (Step S28).

When it is judged that the number of times of collation of the first collation processing is not the preset number of times or more (Step S28; No), the processing returns to that at Step S23.

When it is judged that the number of times of collation of the first collation processing is the preset number of times or more (Step S28; Yes), an informing screen to inform abnormality is displayed on the display screen of the operation display section 500, and error information is performed to the user (Step S29). The present processing is then ended.

FIG. 6 shows the flow chart showing light quantity correction data writing processing of the present embodiment.

The flow chart of the light quantity correction data writing processing shown in FIG. 6 shows an example of the flow chart in the case where the activation period is set as the period when no processing related to image data is being performed.

When the supply of electric power to the image forming apparatus 1 is started by an operation of the power source switch provided in the operation display section 500 of the image forming apparatus 1 (Step S31), it is judged whether an writing instruction of light quantity correction data has been input or not (Step S32).

In the embodiment, in the case where a writing instruction of the light quantity correction data has been accepted from an external apparatus through the external I/F 601 before the execution of the processing shown in FIG. 6, or in the case where a writing instruction of the light quantity correction data has been accepted from the operation display section 500, the light quantity correction data to be written is written into the light quantity correction data memory 420 to be stored and to update the light quantity correction data memory 420, and that a flag instructing the existence of the writing instruction is set in the HDD 105. By referring to the flag, the existence of the writing instruction of the light quantity correction data is judged at the Step S32.

When it is judged that no writing instruction of the light quantity correction data has been input (Step S32; No), the processing advances to that at Step S36.

When it is judged that the writing instruction of the light quantity correction data has been input (Step S32; Yes), the RFID reader/writer 720 is driven to transmit the light quantity correction data stored in the light quantity correction data memory 420 and the writing instruction of the light quantity correction data from the RFID reader/writer 720 to the RFID tag 710 (Step S33).

The RFID tag 710 rewrites the light quantity correction data stored in the IC chip to the light quantity correction data received from the RFID reader/writer 720 in response to the supply of the electric power generated by the inductive electromagnetic field supplied from the RFID reader/writer 720 and updates the light quantity correction data (Step S34). The RFID tag 710 then transmits a signal indicating the completion of the writing (writing completion signal) to the RFID reader/writer 720 (Step S35).

After the judgment result of no at the Step S32, after the processing at the Step S33, or when the RFID reader/writer 720 has received the writing completion signal from the RFID tag 710 (after the Step S35), the activation processing of the processing related to the image data in the image forming apparatus 1 is started (Step S36), and the present processing is ended.

Incidentally, the flow chart in the case where the waiting period is set as the period when no processing related to image data is being performed is the one in which the Step S31 shown in FIG. 6 is set as the case where no processing related to image data is being performed and the Step S36 is deleted. Because the other steps are almost the same as those of the flow chart shown in FIG. 6, the illustration and the description of the former flow chart is omitted.

Moreover, the flow chart in the case where the ending period is set as the period when no processing related to image data is being performed is the one in which the Step S31 shown in FIG. 6 is set as the step of the case where the stop of the supply of electric power to the image forming apparatus 1 is instructed by an operation of the power source switch provided in the operation display section 500 of the image forming apparatus 1 and no processing related to image data is being performed, and in which the Step S36 is deleted. Because the other steps of the flow chart are almost the same as those of the flow chart of FIG. 6, the illustration and the description of the former flow chart are omitted.

As described above, according to the present embodiment, in the period when no processing related to image data is being performed, the reading and the writing of light quantity correction data are performed by the wireless communication between the RFID tag 710 and the RFID reader/writer 720, and the read light quantity correction data can be stored. Consequently, the facilitation of the reading/writing operations of light quantity correction data can be attained without producing the influences of the electromagnetic waves generated by wireless communication and without sacrificing any printing ability, and the speeding-up and the stabilization of the communication of light quantity correction data can be attained. Furthermore, the reliability of the image forming apparatus can be heightened.

Moreover, in the case where light quantity correction data is read from the RFID tag 710, by performing the first collation processing, it can be judged whether any errors are produced in light quantity correction data on the communication pathway between the RFID tag 710 and the RFID reader/writer 720 or not, and the stabilization and the reliability of communication can be heightened. Consequently, error correction procedures such as re-transmission can be executed. Furthermore, when light quantity correction data is read from the RFID tag 710 in the activation period and the waiting period, it can be presumed whether there is the possibility of any alterations of the light quantity correction data stored in the RFID tag 710 or the light quantity correction data memory 420 or not by performing the second collation processing, and the reliability of the light quantity correction data can consequently be heightened. The reliability of the image forming apparatus 1 can thus be heightened.

Furthermore, when the result of the first collation processing or the second collation processing indicates disagreement, the fact of the abnormality can be informed. Consequently, it becomes possible for a user to recognize the abnormality.

Moreover, the present invention is not limited to the contents of the embodiment described above, but the embodiment can be suitably modified without departing from the spirit and the scope of the present invention.

According to an aspect of one embodiment of the present invention, an image forming apparatus includes: an exposure section to form an electrostatic latent image on a photosensitive body on the basis of image data, the exposure section including a plurality of LED elements; an RFID tag provided in the exposure section, the RFID tag including a light quantity correction data storing section to store light quantity correction data for adjusting light quantities of the LED elements and a communication section to perform wireless communication; an RFID reader/writer to perform the wireless communication with the RFID tag; a control section to allow the RFID reader/writer to perform the wireless communication with the RFID tag so as to read or write the light quantity correction data from/to the light quantity correction data storing section of the RFID tag during a period when no processing related to the image data is performed; and a storage section to store the light quantity correction data read by the control section from the light quantity correction data storing section of the RFID tag.

In the image forming apparatus, in the period when no processing related to image data is being performed, the reading or the writing of the light quantity correction data is performed by the wireless communication between the RFID tag and the RFID reader/writer, and the read light quantity correction data can be stored. Consequently, the facilitation of the reading and writing operations of the light quantity correction data can be attained without producing any influences of electromagnetic waves generated by the wireless communication and without sacrificing any printing abilities. Moreover, the speeding-up and the stabilization of the communication of the light quantity correction data can be attained, and the reliability of the image forming apparatus can be heightened.

Preferably, in the image forming apparatus, the period when no processing related to the image data is performed is at least one of a period from a start of supplying electric power to the image forming apparatus to a start of the processing related to image data, and a period when the processing related to the image data is not being performed and the electric power is supplied to the image forming apparatus.

In the image forming apparatus, the period from the start of supplying the electric power to the image forming apparatus to the start of the processing related to the image data (activation period) or the period when the processing related to the image data is not being performed in the state in which the electric power is supplied to the image forming apparatus (waiting period) is set. The reading or the writing of the light quantity correction data can consequently be performed by the wireless communication between the RFID tag and the RFID reader/writer without producing any influences of the electromagnetic waves generated by the wireless communication.

Preferably, in the image forming apparatus, the period when no processing related to the image data is performed is a period from an end of the processing related to the image data to a stop of supplying of electric power to the image forming apparatus, after acceptance of an instruction to stop the supply of the electric power to the image forming apparatus.

In the image forming apparatus, the period from the end of the processing related to the image data to the stop of the supply of the electric power to the image forming apparatus after the acceptance of the instruction to stop the supply of the electric power to the image forming apparatus (ending period) is set. The reading or the writing of the light quantity correction data can consequently be performed by the wireless communication between the RFID tag and the RFID reader/writer without producing any influences of the electromagnetic waves generated by the wireless communication.

Preferably, in the image forming apparatus, the light quantity correction data includes checksum data of the light quantity correction data, and if the control section reads the light quantity correction data from the light quantity correction data storing section of the RFID tag during at least one of the period from the start of supplying the electric power to the image forming apparatus to the start of the processing related to the image data, and the period when the processing related to the image data is not being performed and the electric power is supplied to the image forming apparatus, the control section calculates checksum data of the read light quantity correction data, and collates the calculated checksum data with the checksum data included in the light quantity correction data stored in the storage section.

In the image forming apparatus, it can be presumed whether there is the possibility of the alteration of the light quantity correction data stored in the RFID tag or the storing section or not. Consequently, the reliability of the light quantity correction data can be heightened, and the reliability of the image forming apparatus can be heightened.

Preferably, in the image forming apparatus, if the control section reads the light quantity correction data from the light quantity correction data storing section of the RFID tag, the control section calculates checksum data of the read light quantity correction data, and collates the calculated checksum data with checksum data included in the read light quantity correction data.

In the image forming apparatus, it can be judged whether any errors are generated in the light quantity correction data on a communication pathway between the RFID tag and the RFID reader/writer or not. The stabilization and the reliability of communication can consequently be heightened, and an error correction procedure such as re-transmission can be performed.

Preferably, the image forming apparatus further includes an informing section to inform abnormality when either of a result of collation of the checksum data calculated from the read light quantity correction data with the checksum data included in the light quantity correction data stored in the storage section by the control section and a result of collation of the checksum data calculated from the read light quantity correction data with the checksum data included in the read light quantity correction data by the control section indicates disagreement.

When the collation result indicates the disagreement, the image forming apparatus can inform the abnormality. The image forming apparatus can consequently enable a user to recognize the abnormality.

Preferably, in the image forming apparatus, the communication section transmits and receives the light quantity correction data stored in the light quantity correction data storing section to and from the RFID reader/writer in response to supply of electric power generated by an inductive electromagnetic field or an electric wave supplied from the RFID reader/writer, and the RFID reader/writer supplies the inductive electromagnetic field or the electric wave to the RFID tag, and transmits and receives the light quantity correction data to and from the light quantity correction data storing section of the RFID tag.

In the image forming apparatus, the RFID tag and the RFID reader/writer of the electromagnetic induction type or the electric wave type can be used.

The present U.S. patent application claims a priority under the Paris Convention of Japanese patent application No. 2006-355614 filed on Dec. 28, 2006, which shall be a basis of correction of an incorrect translation.

What is claimed is:

1. An image forming apparatus comprising:

an exposure section to form an electrostatic latent image on a photosensitive body on the basis of image data and light quantity correction data, the exposure section including a plurality of LED elements;

an RFID tag provided in the exposure section, the RFID tag including a light quantity correction data storing section to store the light quantity correction data for adjusting light quantities of the LED elements, and a communication section to perform wireless communication;

an RFID reader/writer to perform the wireless communication with the RFID tag;

a reading control section to make the RFID reader/writer perform the wireless communication with the RFID tag so as to read the light quantity correction data from the light quantity correction data storing section of the RFID tag during a period when no processing related to the image data is performed;

a storage section to store the light quantity correction data read by the reading control section from the light quantity correction data storing section of the RFID tag; and a writing control section to transmit light quantity correction data to be written to the RFID tag by making the RFID reader/writer perform the wireless communication with the RFID tag during the period when no processing related to the image data is performed when receiving a writing instruction of the light quantity correction data from an external apparatus through an operation section or through an external I/F provided in the image forming apparatus, and to rewrite the stored light quantity correction data in the light quantity correction data storing section of the RFID tag into the transmitted light quantity correction data so as to update the data.

2. The image forming apparatus of claim 1, wherein the period when no processing related to the image data is performed is at least one of a period from a start of supplying electric power to the image forming apparatus to a start of the processing related to image data, and a period when the processing related to the image data is not performed and the electric power is supplied to the image forming apparatus.

3. The image forming apparatus of claim 2, wherein the light quantity correction data includes checksum data of the light quantity correction data, and when the reading control section reads the light quantity correction data from the light quantity correction data storing section of the RFID tag during at least one of the period from the start of supplying the electric power to the image forming apparatus to the start of the processing related to the image data, and the period when the processing related to the image data is not being performed and the electric power is supplied to the image forming apparatus, the reading control section calculates checksum data of the read light quantity correction data, and collates the calculated checksum data with the checksum data included in the light quantity correction data stored in the storage section.

4. The image forming apparatus of claim 3, further comprising an informing section to inform abnormality when a result of collation of the checksum data calculated from the read light quantity correction data with the checksum data included in the light quantity correction data stored in the storage section by the reading control section indicates disagreement.

5. The image forming apparatus of claim 1, wherein the period when no processing related to the image data is performed is a period from an end of the processing related to the image data to a stop of supplying of electric power to the image forming apparatus, after acceptance of an instruction to stop the supply of the electric power to the image forming apparatus.

6. The image forming apparatus of claim 1, wherein, when the reading control section reads the light quantity correction data from the light quantity correction data storing section of the RFID tag, the reading control section calculates checksum data of the read light quantity correction data, and collates the calculated checksum data with checksum data included in the read light quantity correction data.

7. The image forming apparatus of claim 6, further comprising an informing section to inform abnormality when a result of collation of the checksum data calculated from the read light quantity correction data with the checksum data included in the read light quantity correction data by the reading control section indicates disagreement.

8. The image forming apparatus of claim 1, wherein the communication section transmits/receives the light quantity correction data stored in the light quantity correction data storing section to/from the RFID reader/writer in response to supply of electric power generated by an inductive electromagnetic field or an electric wave supplied from the RFID reader/writer, and the RFID reader/writer supplies the inductive electromagnetic field or the electric wave to the RFID tag, and transmits/receives the light quantity correction data to/from the light quantity correction data storing section of the RFID tag.

9. An image forming apparatus comprising:

an exposure section to form an electrostatic latent image on a photosensitive body on the basis of image data and light quantity correction data, the exposure section including a plurality of LED elements;

an RFID tag provided in the exposure section, the RFID tag including a light quantity correction data storing section to store the light quantity correction data for adjusting light quantities of the LED elements, and a communication section to perform wireless communication;

an RFID reader/writer to perform the wireless communication with the RFID tag;

a reading control section to make the RFID reader/writer perform the wireless communication with the RFID tag so as to read the light quantity correction data from the light quantity correction data storing section of the RFID tag during a period when no processing related to the image data is performed; and a storage section to store the light quantity correction data read by the reading control section from the light quantity correction data storing section of the RFID tag;

wherein the period when no processing related to the image data is performed is a period from an end of the processing related to the image data to a stop of supplying of electric power to the image forming apparatus, after acceptance of an instruction to stop the supply of the electric power to the image forming apparatus.

10. An image forming apparatus comprising:

an exposure section to form an electrostatic latent image on a photosensitive body on the basis of image data and light quantity correction data, the exposure section including a plurality of LED elements;

an RFID tag provided in the exposure section, the RFID tag including a light quantity correction data storing section to store the light quantity correction data for adjusting light quantities of the LED elements, and a communication section to perform wireless communication;

an RFID reader/writer to perform the wireless communication with the RFID tag;

a reading control section to make the RFID reader/writer perform the wireless communication with the RFID tag so as to read the light quantity correction data from the light quantity correction data storing section of the RFID tag during a period when no processing related to the image data is performed; and a storage section to store the light quantity correction data read by the reading control section from the light quantity correction data storing section of the RFID tag;

wherein the period when no processing related to the image data is performed is at least one of a period from a start of supplying electric power to the image forming apparatus to a start of the processing related to image data, and a period when the processing related to the image data is not performed and the electric power is supplied to the image forming apparatus;

the light quantity correction data includes checksum data of the light quantity correction data, and when the reading control section reads the light quantity correction data from the light quantity correction data storing section of the RFID tag during at least one of the period from the start of supplying the electric power to the image forming apparatus to the start of the processing related to the image data, and the period when the processing related to the image data is not being performed and the electric power is supplied to the image forming apparatus, the reading control section calculates checksum data of the read light quantity correction data, and collates the calculated checksum data with the checksum data included in the light quantity correction data stored in the storage section.

11. The image forming apparatus of claim 10, further comprising an informing section to inform abnormality when a result of collation of the checksum data calculated from the read light quantity correction data with the checksum data included in the light quantity correction data stored in the storage section by the reading control section indicates disagreement.

12. An image forming apparatus comprising:

an exposure section to form an electrostatic latent image on a photosensitive body on the basis of image data and light quantity correction data, the exposure section including a plurality of LED elements;

an RFID tag provided in the exposure section, the RFID tag including a light quantity correction data storing section to store the light quantity correction data for adjusting light quantities of the LED elements, and a communication section to perform wireless communication;

an RFID reader/writer to perform the wireless communication with the RFID tag;

a reading control section to make the RFID reader/writer perform the wireless communication with the RFID tag so as to read the light quantity correction data from the light quantity correction data storing section of the RFID tag during a period when no processing related to the image data is performed; and a storage section to store the light quantity correction data read by the reading control section from the light quantity correction data storing section of the RFID tag;

wherein, when the reading control section reads the light quantity correction data from the light quantity correction data storing section of the RFID tag, the reading control section calculates checksum data of the read light quantity correction data, and collates the calculated checksum data with checksum data included in the read light quantity correction data.

13. The image forming apparatus of claim 12, further comprising an informing section to inform abnormality when a result of collation of the checksum data calculated from the read light quantity correction data with the checksum data included in the read light quantity correction data by the reading control section indicates disagreement.

* * * * *